United States Patent [19]

Yamato

[11] Patent Number: 4,656,759

[45] Date of Patent: Apr. 14, 1987

[54] AERATION-TYPE ROTARY DRYER

[75] Inventor: Yukio Yamato, Chuo, Japan

[73] Assignee: Yamato Sanko Mfg. Co., Ltd., Tokyo, Japan

[21] Appl. No.: 834,275

[22] PCT Filed: Jul. 2, 1985

[86] PCT No.: PCT/JP85/00368

§ 371 Date: Feb. 24, 1986

§ 102(e) Date: Feb. 24, 1986

[30] Foreign Application Priority Data

Jul. 3, 1984 [JP] Japan ..... 59-136589

[51] Int. Cl.[4] ..... F26B 11/04

[52] U.S. Cl. ..... 34/134; 34/135; 34/138

[58] Field of Search ..... 34/134, 135, 136, 137, 34/138; 432/105, 108, 117

[56] References Cited

U.S. PATENT DOCUMENTS 3,874,092 4/1975 Huttlin ..... 34/134

*Primary Examiner*—Larry I. Schwartz

*Attorney, Agent, or Firm*—Birch, Stewart, Kolasch & Birch

[57] ABSTRACT

A direct heat rotary dryer having a single-wall rotating cylinder (10), an axial duct (20) connected to a hot-air source to axially extend inside the cylinder, a plurality of radial ducts (21) branched from the axial duct, each radial duct extending slantingly downwardly near to the inner surface of the cylinder and being formed with a nozzle, whereby hot air flows through materials so that an efficient heat-transfer is made between the materials and the hot air. A plurality of pins (25) are provided on the inner surface of the cylinder (10) along a circle between two adjacent radial ducts (21) to prevent materials from forming lumps.

3 Claims, 18 Drawing Figures

AERATION-TYPE ROTARY DRYER

TECHNICAL FIELD

The present invention relates to an aeration-type rotary dryer that is capable of quick and efficient treatment irrespective of the properties of materials to be dried.

BACKGROUND ART

The known aeration-type rotary dryer, such as a Roto-Louvre dryer, is highly efficient if materials are not sticky. However, it is expensive as compared with the ordinary or non-aeration rotary dryer, because of having a complicated double-wall cylinder and sealing means for sliding portions between the hot-air inlet and the air chambers. Besides, it is not suitable for sticky materials because of being incapable of preventing formation of lumps.

On the other hand, the non-aeration rotary dryer is simple in construction and available for drying sticky materials, but incapable of quick and efficient treatment.

The present invention is intended to resolve the problem as described above and provide an aeration-type rotary dryer that is relatively simple in construction and capable of quick and efficient treatment irrespective of the properties of materials.

DISCLOSURE OF THE INVENTION

The present invention consists in a rotary dryer having inlet and outlet boxes, a single-wall rotating cylinder rotatably, air-sealingly supported by the inlet and outlet boxes, an axial duct having an end connected to a hot-air source and axially extending within the cylinder, a plurality of radial ducts branched slantingly, downwardly from the axial duct, each radial duct having a free end positioned in the vicinity of the inner surface of the cylinder and provided with a nozzle. The cylinder is provided with two riding rings and a girth gear driven by a drive assembly. Each riding ring is rotatably supported by a trunnion assembly.

The inlet box is equipped with a feeder through which materials are put into the cylinder. The outlet box has a discharge port from which the finished product is discharged. An air-exhaust port is attached to either or both of the inlet and outlet boxes.

The materials are fed into inlet-side end of the cylinder by the feeder to progress through the cylinder by virtue of rotation and slope of the cylinder to the outlet box. Meantime, the materials accumulate in the underside of the cylinder to form an inclined surface into which the radial ducts plunge. Hot air is supplied through the axial duct to each radial duct to blow from the nozzle into the materials. Thus, a sufficient heat-transfer is made between the materials and the hot air. The materials can not be discharged without being subjected to the hot air blowing from all the radial ducts which are axially alined from the inlet-side end of the cylinder to the outlet-side end, thereby the materials being efficiently treated within a relatively short time.

The cylinder is preferably provided with a plurality of radial pins which are disposed on the inner surface of the cylinder along a circle between the two adjacent radial ducts to prevent the materials from forming lumps. A lump of materials, when formed, is easily caught by two adjacent radial ducts and broken by the radial pin passing therebetween.

BEST MODE OF CARRYING OUT THE INVENTION

The present invention is described in detail below with reference to drawings which illustrate preferred embodiments.

Figure 1:
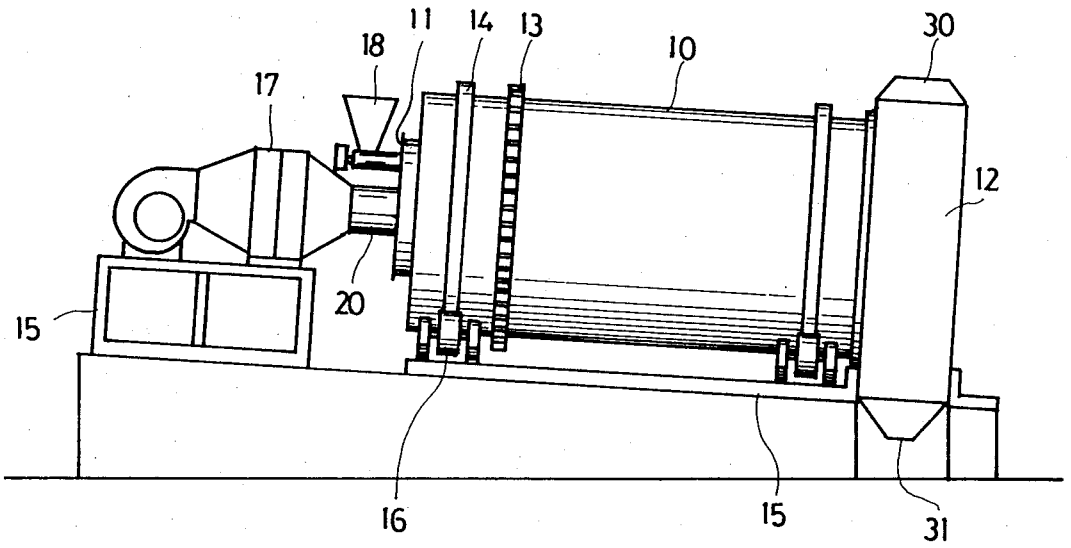
FIG. 1 is a front elevation of the dryer of the invention.

As seen in FIG. 1, the dryer has a rotating cylinder 10 rotatably, air-tightly supported by inlet and outlet boxes 11, 12. The rotating cylinder 10 is provided on its outer surface with a girth gear 13 and two riding rings 14, which are rotatably supported by a trunnion assembly 16 on a base 15. The gear 13 is engaged with a non-illustrated drive assembly which is disposed to rotate the rotating cylinder through the gear. On the base 15 is also disposed a hot-air source 17 composed of a blower and a burner. The hot-air source 17 has an outend attached to an axial duct 20, which passes through the inlet box 11 to enter the rotating cylinder 10. The inlet box 11 is provided with a material feeder 18. The outlet box 12 is equipped with an exhaust port 30 and a discharge port 31.

Figure 2:
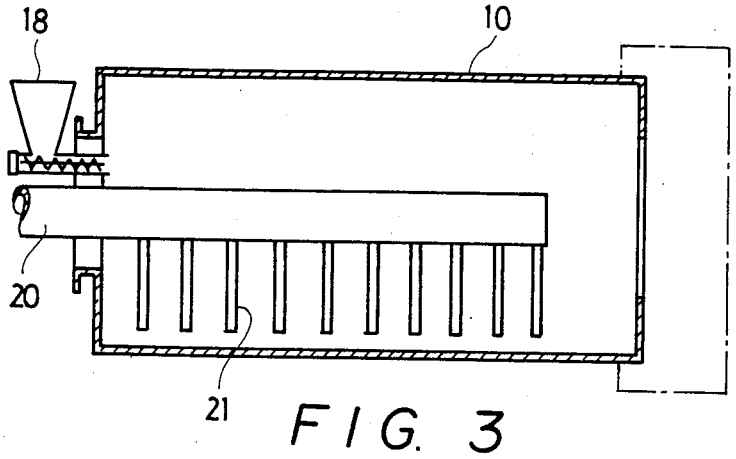
FIGS. 2 and 3 are longitudinal and cross sections of the rotating cylinder of FIG. 1.
Figure 3:
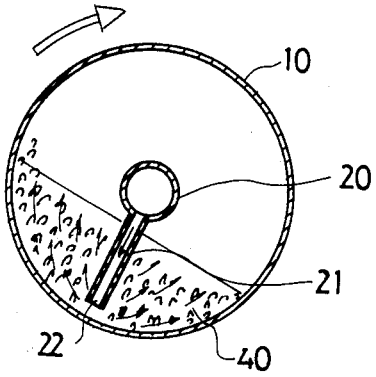

As seen in FIG. 2, the rotating cylinder 10 is of a single-wall cylinder with opposite open side ends. The axial duct 20 axially extends in the rotating cylinder 10 and branches to a plurality of radial ducts 21. The feeder 18 throws materials in the inlet-side end portion of the rotating cylinder 10. Every radial duct 21 extends downwardly near to the inner surface of the rotating cylinder 10. As seen in FIG. 3 in which the rotating cylinder 10 rotates in the direction shown by a coarse arrow, the materials 40 accumulate in the underside of the inner surface of the cylinder 10 to form an inclined surface to which an apex of each radial duct 21 is almost perpendicularly plunged. Hot air is prepared in the hot-air source and supplied to the radial ducts 21 through the axial duct 20. The apex of each radial duct 21 is provided with a nozzle 22, from which hot air blows into and through the materials 40 as shown by the fine arrows, so that a sufficient heat-transfer is made between the hot air and the materials. The materials can not reach the outlet box without being subject to the hot air injected from the nozzle 22 of every radial ducts 21, thereby being evenly dried for a relatively short time even if they has a high moisture content. No lifting flights are provided in the inner surface of the rotating cylinder 10 for precaution of pulverization of the material, but agitating flights can be provided if necessary.

For example, granular coal with a moisture content of 15% can be dried for 30 minutes by hot air having an inlet temperature of 300° C. and an exhaust temperature of 80° C. or a heat capacity of 1000 Kcal/sqm Chr. The heat capacity is larger than that of the known dryer. This leads to an advantage in that the inventive dryer can be compact as compared with the known dryer.

Figure 4:
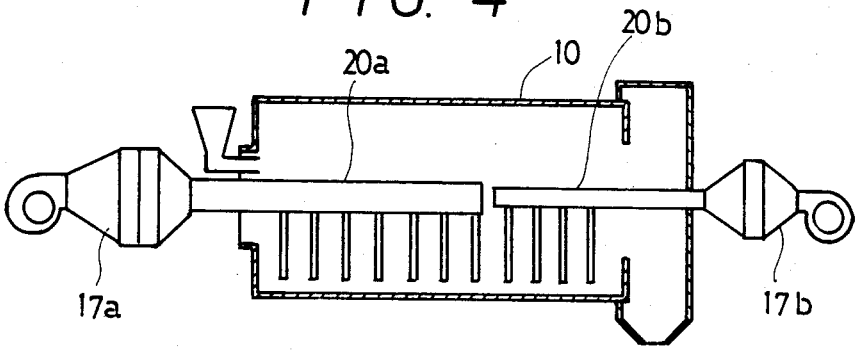
FIGS. 4 to 7 are views similar to FIG. 2, of different embodiments.
Figure 5:
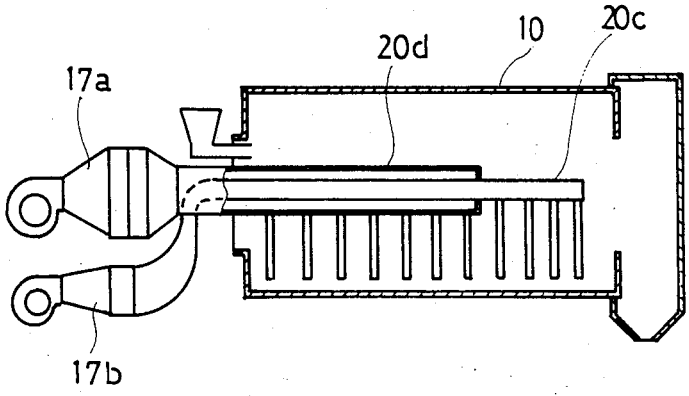

As seen in FIGS. 4 and 5, the rotating cylinder 10 is provided with a hot-air source composed of two members 17*a* and 17*b* producing the respective hot air with different temperatures, so that the materials, as progress through the cylinder 10, are treated under different temperatures. The two members 17*a* and 17*b* of FIG. 4 are disposed in the opposite sides of the rotating cylinder 10 and respectively connected to two serial pipes 20*a* and 20*b* which are inserted into the cylinder 10 from the opposite sides as an axial duct. The two pipes 20*a*, 20*b* branch to the respective radial ducts. The two members 17*a* and 17*b* of FIG. 5 are disposed in the same side of the cylinder 10 and connected to coaxial outer and inner pipes 20*d* and 20*c*, which branch the individual radial ducts.

Figure 6:
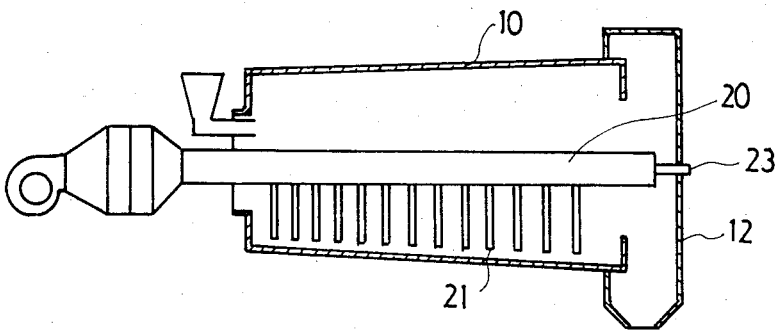

As seen in FIG. 6, the rotating cylinder 10 can be conical. The axial duct 20 branches to a plurality of radial ducts 21 with different lengths, the one in the outlet side being longer than the other in the inlet side. The axial duct 20 has its other end supported by the outlet box 12 with the intervention of a rod 23.

Figure 7:
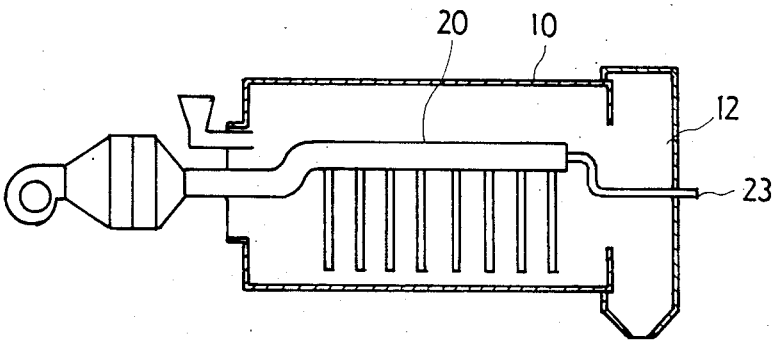
Figure 8:
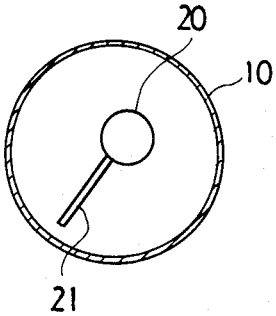
FIG. 8 is a cross-section of the rotating cylinder of FIG. 7.

As seen in FIGS. 7 and 8, the axial duct 20 is in a position above the axis of the rotating cylinder 10 and provided with radial ducts 21 which has a length larger than the inner radius of the cylinder with the result that a relatively large amount of materials can be fed in the cylinder. The axial duct 20 has a rod 23 attached to the other end and supported by the outlet box 12.

Figure 9:
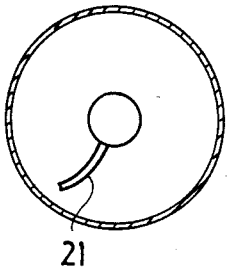
FIGS. 9 to 12 are views similar to FIG. 3, of different embodiments.
Figure 10:
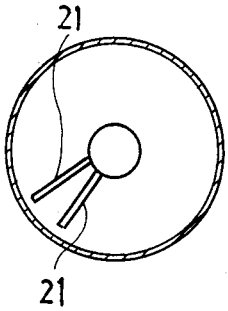

The radial duct 21 is not limited to a straight one of FIGS. 3 to 8, but can be curved as seen in FIG. 9 or bifurcated as seen in FIG. 10.

Figure 11:
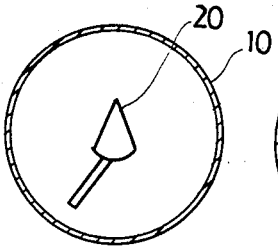
Figure 12:
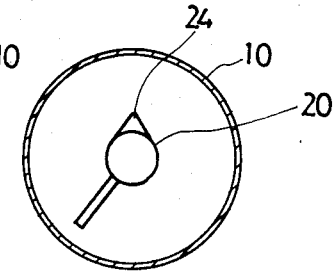

Sometimes, the materials stick to the inner surface of the rotating cylinder and then fall as dust on the upper surface of the axial duct. In preference, the axial duct 20 in the cylinder 10 has a triangular section as seen in FIG. 11 or triangular cover 24 as seen in FIG. 12 to prevent the dust from accumulating on it.

Figure 13:
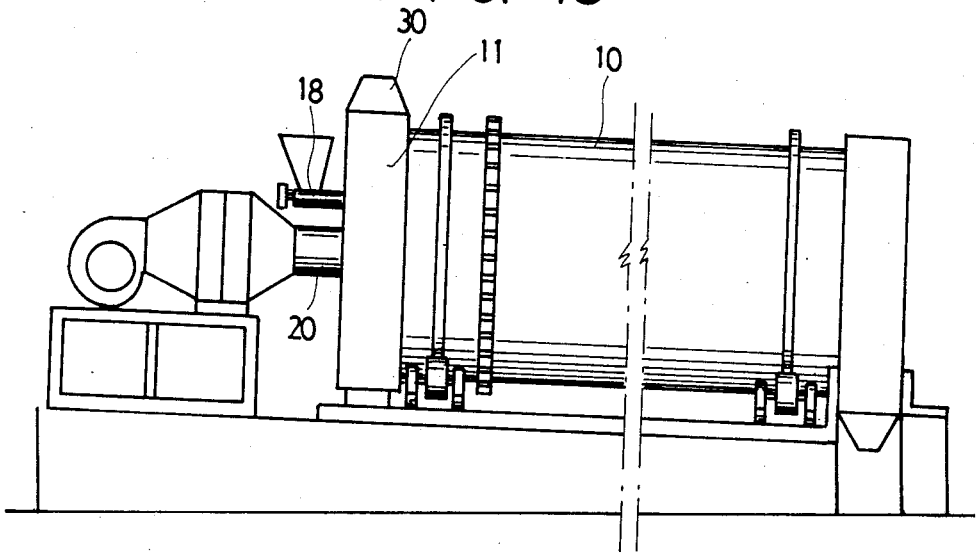
FIGS. 13 to 15 are views respectively similar to FIGS. 1 to 3, of another embodiment.
Figure 14:
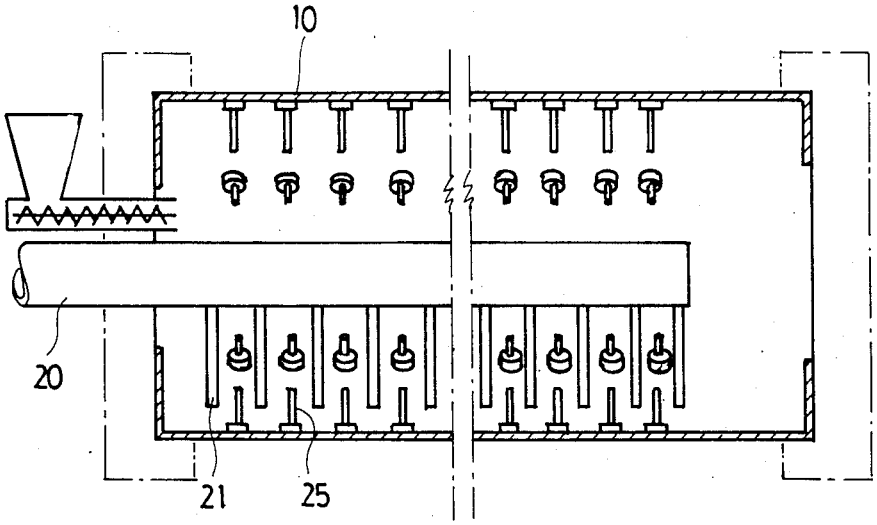
Figure 15:
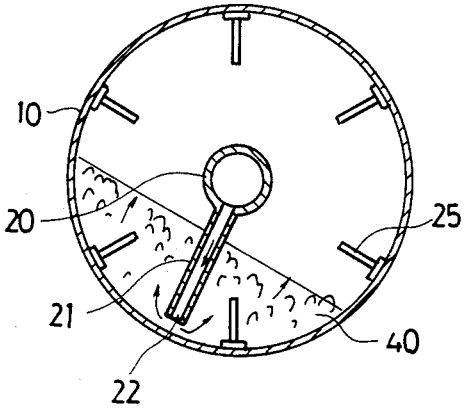

As seen in FIG. 13, the exhaust port 30 can be formed in the inlet box 11 through which the materials are supplied to the cylinder 10 by the feeder 18. The materials are pre-heated while passing through the inlet box 11 prior to being heated in the rotating cylinder 10 to which the axial duct 20 send hot air. As seen in FIG. 14, a plurality of radial pins 25 are disposed on a circle between two adjacent radial ducts 21, which are equidistantly branched from the axial duct 20. Each radial pin 25 is fixed to the inner surface of the rotating cylinder 10. As seen in FIG. 15, six radial pins 25 are equiangularly disposed on the inner surface of the cylinder 10, while the radial duct 21 extends slantingly downwardly in the vicinity of the inner surface of the rotating cylinder 10 to plunge into the materials 40. The axial duct 20 provides each radial duct 21 with hot air, which injects from the nozzle 22 into the materials 40 and flows through the materials as shown by fine arrows. Thus, a sufficient heat-exchange is made between the hot air and the materials. Meanwhile, the radial pins 25 pass by the radial pipe 21, as the rotating cylinder 10 turns.

Figure 16:
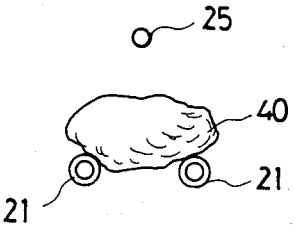
FIGS. 16 to 18 are pictorial views illustrating the steps in which a lump of materials is broken by a radial pin.
Figure 17:
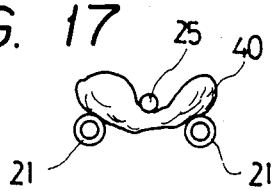
Figure 18:
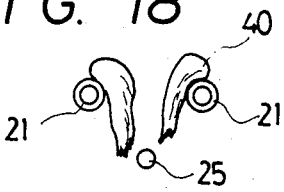

Some sticky materials, while being dried, are easy to form lumps. But, such a lump is soon broken as seen in FIGS. 16 to 18. The lump of materials 40 is caught by two adjacent radial ducts 21 as seen in FIG. 16, and then broken by the radial pin 25 which passes between two radial ducts 21 as seen in FIGS. 17 and 18. This means that the inventive dryer is free from deterioration in efficiency even when it dries cohesive or easily lump-forming materials and that it produce evenly dried products.

INDUSTRIAL APPLICABILITY

From the foregoing, the dryer of the invention is capable of quick and efficient treatment irrespective of the properties of materials and available for drying such sticky materials that have hardly been treated by the known dryer.

I claim:

1. An aeration-type dryer comprising inlet and outlet boxes, a rotary cylinder having opposite open end portions rotatably and air-tightly supported by said inlet and outlet boxes, a hot-air source, a feeder provided in said inlet box, an exhaust port, a discharge port provided in said outlet box, an axial duct axially extending from said hot-air source into said rotating cylinder, a plurality of radial ducts branched slantingly downwardly from said axial duct near to an inner surface of said rotating cylinder, and a nozzle formed in an outer end of each radial duct, said axial duct comprising coaxial inner and outer pipes, said hot-air source consisting of first and second members, said inner and outer pipes being respectively connected to said first and second members, said inner pipe having a portion axially projecting from said outer pipe to branch to a first group of radial ducts, said outer pipe branching to a second group of radial ducts.

2. The dryer of claim 1 wherein said exhaust port is formed in said inlet box.

3. The dryer of claim 1 wherein said rotating cylinder is provided with a plurality of radial pins equiangularly disposed on a circle between two adjacent radial ducts.

* * * * *